United States Patent [19]

Naka

[11] 4,211,048

[45] Jul. 8, 1980

[54] CONCRETE ANCHOR

[75] Inventor: Kozaburo Naka, Tokyo, Japan

[73] Assignee: Kabushiki Kaisha Mikado, Tokyo, Japan

[21] Appl. No.: 961,781

[22] Filed: Nov. 17, 1978

[51] Int. Cl.[2] ..... E04B 1/41

[52] U.S. Cl. ..... 52/700; 85/32 R

[58] Field of Search ..... 52/669, 700, 704

[56] References Cited

U.S. PATENT DOCUMENTS

| | | | |
|---|---|---|---|
| 803,089 | 10/1905 | Bigelow | 52/699 |
| 1,837,930 | 12/1931 | Waite | 52/700 |
| 1,940,545 | 12/1933 | Holmes . | |
| 3,405,497 | 10/1968 | McNair . | |
| 3,514,917 | 6/1970 | Merrill | 52/704 |

FOREIGN PATENT DOCUMENTS 53-22978 6/1978 Japan .

*Primary Examiner*—John E. Murtagh

*Attorney, Agent, or Firm*—Jordan and Hamburg

[57] ABSTRACT

An anchor which is embedded in a concrete ceiling for suspension of a ceiling panel, electrical wiring pipe or air conditioning duct or the like comprises a metallic suspension member and a support member formed of a synthetic resin material. The suspension member includes a cylindrical body which is open at its lower end and having an axial threaded bore, a circular head flange on the top end of the body, and a plurality of needles having their one end secured to said flange and extending downwardly in parallel and spaced relationship with the body. The support member includes a sleeve surrounding the body and a pedestal extending from the lower end of the sleeve in radially outward direction. The pedestal is formed with a plurality of openings which receive the needles, the needles passing through the corresponding openings to the lower side thereof.

4 Claims, 6 Drawing Figures

CONCRETE ANCHOR

FIELD OF THE INVENTION

The invention relates to an anchoring device, and more particularly, to a concrete anchor which is previously embedded in a concrete ceiling for suspension of a ceiling panel, electrical wiring pipe, air conditioning duct, luminaire or the like.

DESCRIPTION OF THE PRIOR ART

U.S. Pat. No. 1,940,545 discloses a concrete anchor including a frusto-conical cast iron body having an internal threaded bore, and a circular metal plate firmly secured to the top of the body. The plate is provided with a plurality of nail holes, in which nails are inserted and hammered to a form when the anchor is mounted on the latter. After the concrete has hardened and the form removed, the threaded bore in the body appears through the concrete surface. However, because the body of this anchor is formed of cast iron, it is unsuitable for recent working modes in which a number of anchors are painted to different colors depending on intended applications.

U.S. Pat. No. 3,405,497 discloses a concrete anchor including a cup with flange which is molded from synthetic resin material so as to be readily colorable. The cup receives an internally threaded cylindrical member which is threadably engaged with the free end of a suspension rod having a large head and which is passed through an opening formed in the top wall of the cup. In use, the flange of the cup is disposed in abutting relationship with a form and nails are driven into the form through openings formed in the flange. However, the nailing operation to the form is rendered difficult inasmuch as the nails must be driven along the outer wall of the cup.

FIG. 6 of this application discloses an anchor which is proposed in Japanese Utility Model Publication No. 22,978/1978 and including a spool-shaped support member 3 formed of a synthetic resin material and having a pair of annular ribs 1, 2 at its axial ends and also including a bore 4 into which a body 6 having a head flange 5 is fitted. The both ribs 1, 2 are formed with a plurality of aligned nail holes 7, and nails 8 are previously inserted to extend through the nail openings in the both ribs. The head of each nail is held between the upper rib 1 of the support member and the head flange 5 of the body 6 while the opposite ends project downwardly beyond the lower rib 2 of the support member 3. Consequently, when the anchor is to be mounted on a form, the hammering of the head flange 5 drives the plurality of nails 8 into the form simultaneously, thus greatly improving the operational efficiency. With this anchor, it is a simple matter to color the anchors differently, by using differently colored support members.

However, this anchor has much to be improved. The use of a spool-shaped support member molded from synthetic resin requires a rather complicated molding operation. A plurality of nails must be separately inserted into openings provided in the annular ribs formed on the opposite ends of the support member by a manual operation, which stands in the way to provide an inexpensive product. Furthermore, when embedded into the concrete block, the upper annular ring of the support member is interposed between the lower surface of the head flange 5 of the body and the concrete block, so that when an increased load is applied to the body, the upper rib may be squeezed, resulting in a rattling of the body within the block. A further problem experienced with this anchor is the need for the body or its head flange to have a non-circular cross section in order to prevent an angular movement of the body within the concrete block when a suspension bolt is threadably engaged with the anchor after the latter has been embedded into the concrete block. However, the non-circular cross section of such member requires an increased machining operation.

SUMMARY OF THE INVENTION

It is an object of the invention to provide a concrete anchor which facilitates its mounting on a form and which prevents a rattling or angular movement thereof after it has been embedded into a concrete block.

It is another object of the invention to provide a concrete anchor which is simple in construction and easy to manufacture.

In accordance with the invention, there is provided an anchor adapted to be embedded into a concrete construction for suspension of a ceiling panel, duct or the like, comprising a metallic suspension member including a cylindrical body having an axial threaded bore which is open at its lower end, a head flange on the top end of a body and a plurality of needles having their one end secured to the flange and extending in parallel and spaced relationship with the body, and a support member formed of a synthetic resin material and including a sleeve which surrounds the body, and a pedestal disposed on the lower end of the sleeve and extending diametrically of the sleeve, the sleeve having an axial length which is the same as or greater than that of the cylindrical body, the pedestal being provided a plurality of openings which receive the needles, each of the needles having a length such that their lower end projects downwardly through the associated opening formed in the pedestal.

In accordance with the invention, the plurality of needles have their one end secured to the lower surface of the head flange of the suspension member, as by known electrical spot welding machine, which simultaneously joins the plurality of needles in a facilitated manner. When the suspension member is to be assembled with the support member, the plurality of needles may be simultaneously inserted into associated openings formed in the pedestal of the support member, whereby the body of the suspension member is received within the sleeve of the support member. Hence, the assembly is completed rapidly. The support member can be manufactured using a metal mold of a simple form.

With the anchor of the invention, the plurality of needles are directly secured to the head flange of the suspension member, and hence serves preventing an angular movement of the suspension member which might otherwise occur in response to an external force. Thus, both the body and the head flange of the suspension member may have a circular cross section. Since the lower surface of the head flange of the suspension member is in direct contact with the concrete block, a load applied to the suspension member does not cause a rattling thereof.

DESCRIPTION OF PREFERRED EMBODIMENTS

Figure 1:
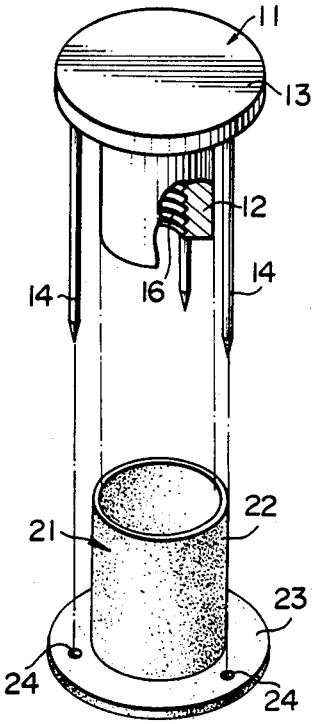
FIG. 1 is an exploded perspective view, partly in section, of the anchor according to the invention.
Figure 2:
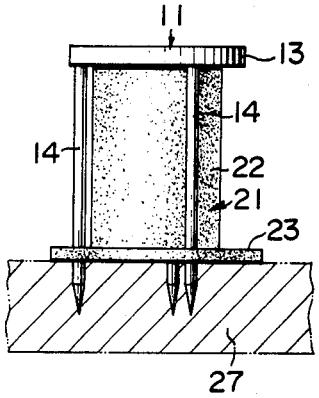
FIG. 2 is a front view, partly in section, of the anchor of FIG. 1 as it is mounted in a form.

Referring to FIG. 1, the anchor of the invention comprises a metallic suspension member 11 and a support member 21 formed of a synthetic resin material. The suspension member 11 includes a cylindrical body 12, a circular head flange 13 disposed on the top end of the body, and a plurality of needles 14, which are three in the present example, having their one end secured to the lower surface of the head flange 13 and angularly spaced apart therearound. The body 12 is formed with an axial threaded bore 16 which is open at the lower end thereof. Each needle 14 extends downwardly from the lower surface of the head flange 13 in parallel and spaced relationship with the outer periphery of body 12. These needles may comprise common nails having their head secured to the lower surface of the head flange 13 as by spot welding. The support member 21 includes a sleeve 22 which is adapted to receive the body 12, and a pedestal 23 extending radially outward from the bottom end of the sleeve 22. The support member 21 is integrally molded from a synthetic resin material which may be colored. The pedestal 23 is formed with a plurality of openings 24 which receive the corresponding needles 14. The sleeve 22 has an axial length which is greater than that of the body 12, but may be equal to the axial length of the body 12. The needles 14 each have a length such that a sufficient length of its free end projects downwardly beyond the opening 24 formed in the pedestal 23 when the body 12 is received within the sleeve 22.

Figure 3:
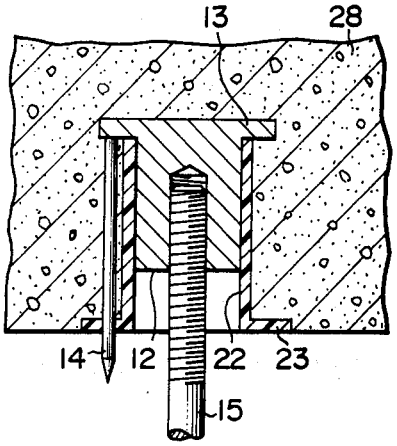
FIG. 3 is a longitudinal section showing the anchor embedded in a concrete block.

In use, the three needles 14 are placed on a form 27 at a given position, and then the head flange 13 is hammered to drive the needles 14 into the form 27 until the pedestal 23 of the support member 21 bears against the top surface of the form 27. Concrete (see FIG. 3) is then cast. After the concrete has hardened, the form 27 may be removed. Thereupon, the threaded bore 16 is exposed through the concrete surface. It will be noted that the body 12 is surrounded by the pedestal 23 which may be colored differently depending on the intended use. That length of the needles 14 which projects beyond the pedestal 23 may be cut off. When the anchor is embedded into a concrete block in this manner, a suspension bolt 15 may be threadably engaged with the bore 16 formed in the suspension member 11, as shown in FIG. 3, allowing a suspension of a ceiling panel, duct or the like therefrom.

Figure 4:
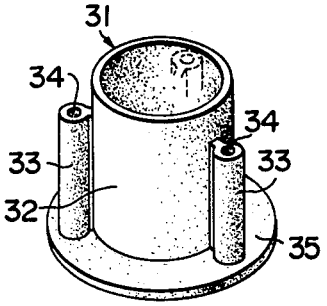
FIG. 4 is a perspective view of another embodiment of the support member.

FIG. 4 shows another embodiment of the support member. In this instance, a support member 31 includes a sleeve 32, along the outer periphery of which are disposed a plurality of ribs 33 extending along part of the axial length thereof. Each rib 33 is formed with a bore 34 for receiving needle 14 of the suspension member 11. It should be understood that the bore 34 also extends through a pedestal 35. When ribs 33 having bores 34 which receive the needles are integrally formed with the sleeve 32, a bending of individual needles 14 can be avoided when the anchor is mounted on the form.

Figure 5:
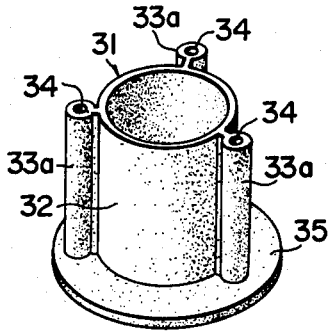
FIG. 5 is a perspective view of a further embodiment of the support member.
Figure 6:
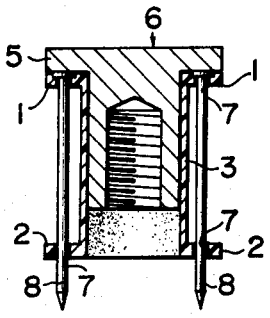
FIG. 6 PRIOR ART
FIG. 6 is a longitudinal section of a known anchor.

FIG. 5 shows a modification of the embodiment shown in FIG. 4 in that each rib **33*a* has an axial length which is equal to that of the sleeve 32, thereby increasing the axial strength of the sleeve 32. This minimizes a damage to the support member which may be caused by hammering when the anchor is to be secured to a form. It is also possible to reduce the wall thickness of the sleeve 32 in this manner. The provision of the ribs 33 in integral manner with the sleeve 32 avoids the formation of a void in the concrete block between the needles 14 and the sleeve 32**.

What is claimed is:

1. An anchor adapted to be embedded into a concrete construction for suspension of a ceiling panel, duct or the like, comprising a metallic suspension member including a cylindrical body having an axial thread bore which is open at its lower end, a head flange disposed on the top end of the body, and a plurality of the needles having their one end secured to the head flange and extending in parallel and spaced relationship with the body, and a support member formed of a synthetic resin material and including a sleeve which surrounds the body and a pedestal disposed at the lower end of the sleeve and extending diametrically of the sleeve, the sleeve having an axial length which is the same as or greater than that of the body, the pedestal being formed with a plurality of openings for receiving the needles, each of the needles having a length such that its free end projects downwardly beyond the associated opening formed in the pedestal.

2. An anchor according to claim 1 in which the body and the head flange are formed integrally, the needles having their one end welded to the head flange.

3. An anchor according to claim 1 in which a plurality of ribs are formed on the outer periphery of the sleeve so as to extend parallel to the axial direction thereof, each rib being formed with a bore which passes one of the needles.

4. An anchor according to claim 3 in which the rib has a length which is equal to that of the sleeve.

* * * * *